US007312010B2

(12) United States Patent
Veregin et al.

(10) Patent No.: US 7,312,010 B2
(45) Date of Patent: Dec. 25, 2007

(54) PARTICLE EXTERNAL SURFACE ADDITIVE COMPOSITIONS

(75) Inventors: Richard P. Veregin, Mississauga (CA); Maria N. McDougall, Burlington (CA); Eric Strohm, Burlington (CA); Dwight J. Tshudy, Salem, MA (US); Thomas R. Pickering, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 394 days.

(21) Appl. No.: 11/094,664

(22) Filed: Mar. 31, 2005

(65) Prior Publication Data

US 2006/0222986 A1 Oct. 5, 2006

(51) Int. Cl.
*G03G 9/08* (2006.01)

(52) U.S. Cl. ..... 430/108.3; 430/108.4; 430/123.51

(58) Field of Classification Search ..... 430/108.3, 430/108.4, 137.14, 122, 123.51; 399/267
See application file for complete search history.

(56) References Cited

U.S. PATENT DOCUMENTS

| | | | |
|---|---|---|---|
| 3,590,000 | A | 6/1971 | Palermiti et al. |
| 3,847,604 | A | 11/1974 | Hagenbach et al. |
| 3,981,272 | A | 9/1976 | Smith et al. |
| 4,155,329 | A | 5/1979 | Tsukamoto et al. |
| 4,265,990 | A | 5/1981 | Stolka et al. |
| 4,465,730 | A | 8/1984 | Okada |
| 4,558,108 | A | 12/1985 | Alexandru et al. |
| 4,678,734 | A | 7/1987 | Laing et al. |
| 4,771,314 | A | 9/1988 | Parker et al. |
| 4,833,504 | A | 5/1989 | Parker et al. |
| 4,847,655 | A | 7/1989 | Parker et al. |
| 4,868,600 | A | 9/1989 | Hays et al. |
| 4,868,608 | A | 9/1989 | Allen, Jr. et al. |
| 4,901,114 | A | 2/1990 | Parker et al. |
| 4,935,326 | A | 6/1990 | Creatura et al. |
| 4,937,166 | A | 6/1990 | Creatura et al. |
| 4,948,686 | A | 8/1990 | Koch et al. |
| 4,984,019 | A | 1/1991 | Folkins |
| 5,010,367 | A | 4/1991 | Hays |
| 5,031,570 | A | 7/1991 | Hays et al. |
| 5,032,872 | A | 7/1991 | Folkins et al. |
| 5,061,969 | A | 10/1991 | Parker et al. |
| 5,119,147 | A | 6/1992 | Hays |
| 5,134,442 | A | 7/1992 | Folkins et al. |
| 5,144,371 | A | 9/1992 | Hays |
| 5,153,647 | A | 10/1992 | Barker et al. |
| 5,153,648 | A | 10/1992 | Lioy et al. |
| 5,171,653 | A | 12/1992 | Jugle et al. |
| 5,172,170 | A | 12/1992 | Hays et al. |
| 5,206,693 | A | 4/1993 | Folkins |
| 5,212,037 | A | 5/1993 | Julien et al. |
| 5,227,460 | A | 7/1993 | Mahabadi et al. |
| 5,245,392 | A | 9/1993 | Bene et al. |
| 5,253,016 | A | 10/1993 | Bene et al. |
| 5,278,020 | A | 1/1994 | Grushkin et al. |
| 5,290,654 | A | 3/1994 | Sacripante et al. |
| 5,300,992 | A | 4/1994 | Wayman et al. |
| 5,308,734 | A | 5/1994 | Sacripante et al. |
| 5,311,258 | A | 5/1994 | Brewington et al. |
| 5,344,738 | A | 9/1994 | Kmiecik-Lawrynowicz et al. |
| 5,345,298 | A | 9/1994 | Corrigan, Jr. |
| 5,346,797 | A | 9/1994 | Kmiecik-Lawrynowicz et al. |
| 5,364,729 | A | 11/1994 | Kmiecik-Lawrynowicz et al. |
| 5,370,963 | A | 12/1994 | Patel et al. |
| 5,403,693 | A | 4/1995 | Patel et al. |
| 5,416,566 | A | 5/1995 | Edmunds et al. |
| 5,418,108 | A | 5/1995 | Kmiecik-Lawrynowicz et al. |
| 5,510,220 | A | 4/1996 | Nash et al. |
| 5,593,807 | A | 1/1997 | Sacripante et al. |
| 5,731,121 | A * | 3/1998 | Asanae et al. ..... 430/108.4 |
| 6,177,221 | B1 | 1/2001 | Maniar et al. |
| 6,319,647 | B1 | 11/2001 | Gutman et al. |
| 6,365,316 | B1 | 4/2002 | Stamp et al. |
| 6,416,916 | B1 | 7/2002 | Silence et al. |
| 2004/0063020 | A1 * | 4/2004 | Stegamat et al. ..... 430/137.1 |

FOREIGN PATENT DOCUMENTS

| | | |
|---|---|---|
| JP | A-02-037363 | 2/1990 |

* cited by examiner

*Primary Examiner*—John L Goodrow
(74) *Attorney, Agent, or Firm*—Oliff & Berridge, PLC

(57) ABSTRACT

A toner having at least one binder, at least one colorant and external additives. The external additives include at least one of silica and titania, and at least two metal stearates. A developer may be produced including the toner having at least two metal stearates and a carrier. An electrophotographic machine includes the toner with two metal stearates.

16 Claims, No Drawings

PARTICLE EXTERNAL SURFACE ADDITIVE COMPOSITIONS

BACKGROUND

This disclosure relates to toners, developers containing the toners, and a method of forming images with the developers utilizing a magnetic brush development system. More in particular, the disclosure relates to toners and developers having controlled properties via a specific external additive set to provide superior print quality and improved admixing of the toner into the developer.

U.S. Pat. No. 6,319,647 describes a toner of toner particles containing at least one binder, at least one colorant, and preferably one or more external additives that is advantageously formed into a developer and used in a magnetic brush development system to achieve consistent, high quality copy images. The toner particles, following triboelectric contact with carrier particles, exhibit a charge per particle diameter (Q/D) of from 0.6 to 0.9 fC/μm and a triboelectric charge of from 20 to 25 μC/g. The toner particles preferably have an average particle diameter of from 7.8 to 8.3 microns. The toner is combined with carrier particles to achieve a developer, the carrier particles preferably having an average diameter of from 45 to 55 microns and including a core of ferrite substantially free of copper and zinc coated with a coating comprising a polyvinylidenefluoride polymer or copolymer and a polymethyl methacrylate polymer or copolymer.

U.S. Pat. No. 6,416,916 describes a toner of toner particles containing at least one binder, at least one colorant, and an external additive package comprised of zinc stearate and at least one of silicon dioxide or titanium dioxide, wherein the amount of zinc stearate is limited to about 0.10 percent by weight or less of the toner. It is reported that when the amount of zinc stearate is so limited, a developer formed from the toner exhibits excellent triboelectric charging and stability and excellent developer flow. When the developer is used in a magnetic brush development system, consistent, high quality copy images are formed substantially without any depletion defects over time.

What is still desired is a toner, preferably for use in magnetic brush development systems, which is able to produce high print quality in all environments. It is also still desired that addition of the toner as an admixture into the developer will not generate any toner that has wrong sign polarity.

SUMMARY

In a first embodiment, a toner is described that comprises toner particles of at least one binder, at least one colorant, and external additives, wherein the external additives include silica and/or titania, and at least two metal stearates selected from the group consisting of zinc stearate, calcium stearate, aluminum stearate and magnesium stearate.

Also described is a developer comprising the toner particles in admixture with carrier particles.

An electrophotographic image forming apparatus is also described that comprises a photoreceptor, a conductive magnetic brush development system, and a housing in association with the conductive magnetic brush development system for a developer comprising the toner having the metal stearate external additive compounds. The conductive magnetic brush development system may also include a hybrid jumping development system or a hybrid scavengeless development system.

DETAILED DESCRIPTION OF EMBODIMENTS

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed by bringing a developer comprised of toner into contact therewith.

Two component and single component developer materials are commonly used. A typical two-component developer material comprises magnetic carriers having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

A commonly known way of developing the latent image on the photoreceptor is by use of one or more magnetic brushes. See, for example, U.S. Pat. Nos. 5,416,566, 5,345,298, 4,465,730, 4,155,329 and 3,981,272, incorporated herein by reference.

In embodiments, conductive magnetic brush developers herein can be selected for hybrid jumping development, hybrid scavengeless development, and similar processes, reference U.S. Pat. Nos. 4,868,600; 5,010,367; 5,031,570; 5,119,147; 5,144,371; 5,172,170; 5,300,992; 5,311,258; 5,212,037; 4,984,019; 5,032,872; 5,134,442; 5,153,647; 5,153,648; 5,206,693; 5,245,392; 5,253,016, the disclosures of which are totally incorporated herein by reference.

The aforementioned developers, which can contain a negatively charging toner, are suitable for use with laser or LED printers, discharge area development with layered flexible photoconductive imaging members, reference U.S. Pat. No. 4,265,990, the disclosure of which is totally incorporated herein by reference, and organic photoconductive imaging members with a photogenerating layer and a charge transport layer on a drum, light lens xerography, charged area development on, for example, inorganic photoconductive members such as selenium, selenium alloys like selenium, arsenic, tellurium, hydrogenated amorphous silicon, trilevel xerography, reference U.S. Pat. Nos. 4,847,655; 4,771,314; 4,833,504; 4,868,608; 4,901,114; 5,061,969; 4,948,686 and 5,171,653, the disclosures of which are totally incorporated herein by reference, full color xerography, and the like, reference for example the Xerox Corporation DocuColor iGen3® Digital Production Press and Xerox Nuvera® 100/120.

In embodiments, the developers are preferably selected for imaging and printing systems with conductive magnetic brush development as illustrated, for example, in U.S. Pat. No. 4,678,734, the disclosure of which is totally incorporated herein by reference, and wherein there is enabled in embodiments high development levels, development to substantially complete neutralization of the photoreceptor image potential, development of low levels of image potentials and increased background suppression.

As explained above, a CMB developer can be used in various systems, for example a hybrid jumping (HJD) system or a hybrid scavengeless development (HSD) system.

In a HJD system, the development roll, better known as the donor roll, is powered by two development fields (potentials across an air gap). The first field is the ac jumping field which is used for toner cloud generation and has a typical potential of 2.6 k volts peak to peak at 3.25 k Hz frequency. The second field is the dc development field which is used to control the amount of developed toner mass on the photoreceptor. It is desirable to eliminate the dc field and use the duty cycle of the ac field to control the toner mass to be developed on the photoreceptor.

HSD technology develops toner via a conventional magnetic brush onto the surface of a donor roll. A plurality of electrode wires is closely spaced from the toned donor roll in the development zone. An AC voltage is applied to the wires to generate a toner cloud in the development zone. This donor roll generally consists of a conductive core covered with a thin, for example 50-200 μm, partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are 700-900 Vpp at frequencies of 5-15 kHz. These AC signals are often square waves, rather than pure sinusoidal waves. Toner from the cloud is then developed onto the nearby photoreceptor by fields created by a latent image.

In any CMB system, toner is removed from the system in order to produce an image on a image recoding medium, such as paper. Accordingly, additional toner must be introduced into the system.

However, fresh toner prior to addition into the system does not have a charge. Thus, the toner needs to be charged to the opposite polarity of the carrier. For example, if the carrier is positively charged, the toner needs to be negatively charged to properly transfer the toner onto the image recording medium. If the toner is the incorrect polarity, the toner will print in the background.

Thus, one benefit of the present disclosure is that the admixture of toner to the developer will charge to the proper polarity due to the metal stearate external surface additive.

In CMB developers, a metal stearate additive is added to an external surface of toner particles to provide adequate developer conductivity. In addition, the metal stearate can have an affect on other toner/developer performance, such as admix, charge, relative humidity (RH) sensitivity and charge distribution.

Currently, either zinc stearate or calcium stearate is individually added to a toner to provide improved RH sensitivity to both conventional jetted polyester toners and emulsion/aggregation (EA) polyester toners. In the EA toner design, zinc stearate provides narrow charge distributions, but gives inherently poor RH sensitivity with any additive design. Calcium stearate provides a greatly improved RH sensitivity for charging, but degrades admix/charge through performance.

It is desirable that toner and developers be functional under all environmental conditions to enable good image quality from a printer. Thus, it is desirable for toners and developers to function at low humidity and low temperature, for example at 10 degrees Celsius and 15% relative humidity (denoted herein as C-zone, at moderate humidity and temperature, for example at 22 degrees Celsius and 50% relative humidity (denoted herein as B-zone), and high humidity and temperature, for example at 28 degrees Celsius and 85% relative humidity (denoted herein as A-zone).

For good performance under all conditions it is important that critical properties of the toner and developer change as little as possible across these environmental zones. If there is a large difference across these zones, the materials have a large RH sensitivity ratio, which means that the toner may show performance shortfalls in the extreme zones, either at low temperature and humidity, or high temperature and humidity, or both. The ultimate goal for critical properties is for the RH sensitivity ratio to be as close to one as possible. When such an RH sensitivity ratio is achieved, the toner is equally effective in both high humidity and low humidity conditions. Said another way, the toner has low sensitivity to changes in RH.

Thus, one object of the present disclosure is to provide better overall performance by including at least two different metal stearates onto a toner particle external surface to balance the negative and positive effects of each individual metal stearate.

The present disclosure is equally applicable to all conductive magnetic brush toner/developers, to conventional jetted toners, and to polyester EA toners and styrene/acrylate EA toners.

This disclosure describes the aspects of novel toners and developers that operate in the conductive magnetic brush development environment to achieve image qualities superior to prior art toners and developers, the developers possessing better triboelectric stability and image quality stability. Color, solids, halftones, gloss, pictorials, text and background are stable over the entire job run.

Suitable and preferred materials for use in preparing toners herein will now be discussed.

Any resin binder suitable for use in toner may be employed without limitation. Further, toners prepared by chemical methods (emulsion/aggregation) and physical methods (grinding) may be equally employed. Specific suitable toner examples are as follows.

The toner can be a polyester toner particle which is known in the art. Polyester toner particles created by the emulsion/aggregation (EA) process are illustrated in a number of patents, such as U.S. Pat. Nos. 5,593,807, 5,290,654. 5,308,734, and 5,370,963, each of which are incorporated herein by reference in their entirety. The polyester may comprise any of the polyester materials described in the aforementioned references. As these references fully describe polyester EA toners and methods of making the same, further discussion on these points is omitted herein.

The toner can be a styrene/acrylate toner particle which is known in the art. Styrene/acrylate toner particles created by the EA process are illustrated in a number of patents, such as U.S. Pat. Nos. 5,278,020, 5,346,797, 5,344,738, 5,403,693, 5,418,108, and 5,364,729, each of which are incorporated herein by reference in their entirety. The styrene/acrylate may comprise any of the materials described in the aforementioned references. As these references fully describe styrene/acrylate EA toners and methods of making the same, further discussion on these points is omitted herein.

The toner can be generated by well known processes other than by EA process. Such conventional jetted toner particles are illustrated in number of patents, such as U.S. Pat. Nos. 6,177,221, 6,319,647, 6,365,316, 6,416,916, 5,510,220, 5,227,460, 4,558,108, and 3,590,000, each of which are incorporated herein by reference in their entirety. The conventional jetted toners comprise materials described in the aforementioned references. As these references fully describe conventional jetted toners made by processes other than the EA process and methods of making the same, further discussion on these points is omitted herein.

Various known colorants, such as pigments, present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours and Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans that may be selected include copper tetra(octadecyl sulfonamido)phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, Yellow 180 and Permanent Yellow FGL, wherein the colorant is present, for example, in the amount of about 3 to about 15 weight percent of the toner. Organic dye examples include known suitable dyes, reference the Color Index, and a number of U.S. patents. Organic soluble dye examples, preferably of a high purity for the purpose of color gamut are Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, and more specifically, from about 5 to 20 weight percent of the toner. Colorants include pigment, dye, mixtures of pigment and dyes, mixtures of pigments, mixtures of dyes, and the like. This listing of colorants is for illustration only, any suitable colorant may be used herein. As understood by one of ordinary skill, pigments are predispersed in a surfactant or resin binder to facilitate mixing.

External additives are additives that associate with the surface of the toner particles. In the present disclosure, the external additives include at least one of silicon dioxide or silica ($SiO_2$), or titania or titanium dioxide ($TiO_2$). In general, silica is applied to the toner surface for toner flow, triboelectric enhancement, admix control, improved development and transfer stability and higher toner blocking temperature. $TiO_2$ is applied for improved relative humidity (RH) stability, triboelectric control and improved development and transfer stability. In a most preferred embodiment, the external additive package includes both silica and titania.

The $SiO_2$ and $TiO_2$ should preferably have a primary particle size of less than 200 nm. The silica preferably has a primary particle size in the range about 5 to about 200 nm. The titania preferably has a primary particle size in the range about 5 to about 50 nm. Of course, larger size particles may also be used, if desired, for example up to about 500 nm. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 50 to 200% surface area coverage (SAC). Another metric relating to the amount and size of the additives is "SAC×Size" ((percentage surface area coverage) times (the primary particle size of the additive in nanometers)), for which the additives should preferably have a total SAC×Size range between, for example, 1,000 to 4,000.

Most preferably, the $SiO_2$ added is surface treated with polydimethylsiloxane, such as RY50 available from Nippon Aerosil. Other suitable treated fumed silicas are commercially available as TS530 from Cabot Corporation, Cab-O-Sil Division. The titania may be either treated or untreated. Untreated titanium dioxide is available as P25 from Degussa. Most preferably the titanium dioxide is surface treated, for example with a decylsilane which is commercially available as MT3103, or as SMT5103, both available from Tayca Corporation.

At least two metal stearate external additives selected from the group consisting of zinc stearate, calcium stearate, aluminum stearate and magnesium stearate are also present on the toners. The metal stearates provide lubricating properties. Due to their lubricating nature, metal stearates also provide triboelectric enhancement. Furthermore, metal stearates enable higher toner charge and charge stability by increasing the number of contacts between toner and carrier particles. One commercially available metal stearate is zinc stearate, having a particle size such that 100% of the material passes through a 325 mesh screen, is known as ZINC STEARATE L™ made by Ferro Corporation, Polymer Additives Division. Other commercially available zinc stearates, such as those available from Synthetic Products Company (Synpro), Fisher Scientific Chemical Division, or the like may also be used.

The metal stearates are thus a necessary external additive in order to maintain high and stable triboelectric performance of the developer. The developer of the present disclosure preferably possesses a triboelectric value (as measured by the known Faraday Cage process) of from, for example, −15 to −40 μC/g. Without the metal stearates as lubricating external additives, the triboelectric value does not remain stable over the life of the developer, unacceptably decaying over the life of the developer.

No single metal stearate can provide all of the desired performance attributes, which frequently leads to some trade-off in performance. For example, U.S. Pat. No. 6,416,916 shows that higher amounts of zinc stearate result in the occurrence of image depletion defects appearing in solid area images, particularly during long print runs. Thus, the amount of zinc stearate in that example must be limited to less than 0.1% loading in the toner.

It has been found that if at least two metal stearates are part of the external additives, various benefits are achieved in the CMB system. In particular, in the HSD development system, by adding more than one metal stearate as an external additive selected from the group consisting of zinc stearate, calcium stearate, aluminum stearate and magnesium stearate to the toner, an excellent combination of the desired performance attributes, such as charge level, charge stability, RH sensitivity, admix, charge-through, charge distribution widths, and developer conductivity, can be achieved. Preferably, the external additives include aluminum stearate and calcium stearate.

The metal stearates are preferably present in the toner particles in an amount of from about 0.025% to about 5.0% by weight of the toner particles, and preferably from about 0.05% to about 3% by weight of the toner particles. When using two metal stearates, the ratio of the two metal stearates can range from 4:1 to 1:1, preferably from 2:1 to 1:1, and more preferably the ratio is approximately 1:1.

Illustrative examples of carrier particles that can be selected for mixing with the toner composition prepared in accordance with the present disclosure include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

In a most preferred embodiment, the carrier core is comprised of atomized steel available commercially from, for example, Hoeganaes Corporation.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, other known coatings and the like.

In another embodiment, the carrier core is partially coated with a polymethyl methacrylate (PMMA) polymer having a weight average molecular weight of 300,000 to 350,000 commercially available from Soken. The PMMA is an electropositive polymer in that the polymer that will generally impart a negative charge on the toner with which it is contacted.

The PMMA may optionally be copolymerized with any desired comonomer, so long as the resulting copolymer retains a suitable particle size-. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

In a another preferred embodiment herein, the polymer coating of the carrier core is comprised of PMMA, most preferably PMMA applied in dry powder form and having an average particle size of less than 1 micrometer, preferably less than 0.5 micrometers, that is applied (melted and fused) to the carrier core at higher temperatures on the order of 220° C. to 260° C. Temperatures above 260° C. may adversely degrade the PMMA. Triboelectric tunability of the carrier and developers herein is provided by the temperature at which the carrier coating is applied, higher temperatures resulting in higher tribo up to a point beyond which increasing temperature acts to degrade the polymer coating and thus lower tribo.

With higher tribo, longer development life and improvement in fringe field development is expected. The toner to carrier ration in the developer is approximately 4.5 pph.

The disclosure will now be further illustrated by way of the following examples and data. It will be obvious to one of ordinary skill in the art that various metal stearate combinations are equally effective as the hereinafter described example.

Toner Preparation

An 8.3 micron EA polyester cyan toner was dry-blended with surface additives at 13,000 rpm for 30 seconds on an SKM mill. All toners were blended with 2.3% silica, 1.9% titania, with 0.1% varying stearates, selected from zinc stearate, calcium stearate, aluminum stearate and magnesium stearate. Also, a toner blend was prepared with 0.05% of each of calcium stearate and aluminum stearate, for a total of 0.1% to illustrate the benefit of mixing two stearates. It has been found generally for these developers that 0.1% of calcium stearate or zinc stearate gives optimal developer conductivity, and further addition of stearate does not increase conductivity. A reduction in stearate from 0.1% degrades conductivity. Thus, all toners were evaluated at a total of 0.1% stearate.

Charging and Conductivity Evaluation

Charging evaluation was done using developers that were conditioned in C-zone and B-zone at 4.5 pph, comprised of 100 g of carrier and 4.5 g of toner, conditioned overnight in B and C-zones prior to charging on a shaker. The carrier was comprised of atomized steel core powder coated with 1% polymethylmethacrylate. Charging of the developer was measured after 15 and 45 minutes for stability using the total blow-off tribo method. At this point, 2.25 g of fresh toner previously conditioned in B and C zones was added to the charged developer to determine admixing rates at 15 seconds and charge through at 120 seconds, by measuring the charge distribution using a charge spectrograph. Developer samples were also prepared at 4.5 pph by adding 3.4 kg of carrier and 154 g of toner, conditioning in B-Zone overnight, and then mixing for 10 minutes in a Littleford M5R blender. The charged developer was then loaded into a Xerox iGen3 developer housing and run at a process speed equivalent to 100 ppm print speed for 2 hours. Developer samples were taken at intervals for charge evaluation by the total blow-off method, for charge distributions by the charge spectrograph method, and for conductivity evaluation. Conductivity was measured by loading 100 g of developer onto a magnetic roll of diameter 3.85 cm and length 8.0 cm, trimming the resultant developer with a trim gap of 2.4 mm and then measuring the current through the brush using an applied voltage of 10 V.

Results

As explained above, it is necessary for the toner particles to be the opposite polarity of the carrier. In this experiment, the carrier is positive and the toner is negative. Also, as explained above, as the toner is used during the printing process, additional toner is added to the development system as an admixture.

As seen from Table 1, after fully charging the developer for 45 minutes with toner containing calcium stearate/aluminum stearate, and then adding in a further 2.25 grams of toner, the charge of the toner was all negative in the B-zone and at 15 seconds and 0 at 120 seconds. This is an improvement compared to toners that contained zinc stearate, calcium stearate or aluminum stearate alone in the B-zone at 120 seconds, as all toners with single stearates showed some wrong-sign polarity toner during the admix test. This indicates that the toner with the mixture of stearates consistently provides developers without wrong-sign polarity. Wrong-sign polarity will lead to increased background during the printing process.

Similarly, the combination of calcium stearate and aluminum stearate produced no wrong-sign polarity toner at any time during the admix experiment, in C-zone at both 15 seconds and 120 seconds of admix time, equivalent performance to zinc stearate and aluminum stearate alone, and improved performance compared to calcium stearate alone.

As can be seen from Table 1, none of zinc stearate, calcium stearate or aluminum stearate provides required toner charging without any wrong-sign polarity toner at all humidities and all times. However, the calcium stearate/aluminum stearate admixture provides correct toner charging at all times in both the B and C-zones. Although, the toner charge at 120 seconds in the B-zone is 0, this is a great improvement to the wrong-sign polarity positive charging when a single metal stearate is used alone. By having 0 toner charge, the image will not print in the background as will toners having the incorrect polarity.

TABLE 1

Admix Data

| Stearate | B-Zone Admix 15 s | B-Zone Admix 120 s | C-Zone Admix 15 s | C-Zone Admix 120 s |
|---|---|---|---|---|
| Zinc stearate | − | + | − | − |
| Calcium stearate | − | + | 0 | + |
| Aluminum stearate | − | + | + | − |
| Mixture Calcium stearate/Aluminum stearate | − | 0 | − | − |

Tables 2-4 below show that the combination of two metal stearates does not substantially affect any toner/developer performance other than the charge of the toner after admixture as demonstrated in Table 1. All data demonstrated in Tables 2-4 are indicative of the toner prior to admixture to the developer.

TABLE 2

Triboelectric Charging Prior to Admix

| Tribo (q/m) | 15 min. C-zone | 45 min. C-zone | 15 min. B-zone | 45 min. B-zone | C:B Ratio 15 min. | C:B Ratio 45 min. |
|---|---|---|---|---|---|---|
| Aluminum stearate | −21.5 | −23.8 | −18.5 | −15.2 | 1.16 | 1.57 |
| Calcium stearate | −27.5 | −29.2 | −23.7 | −20.2 | 1.16 | 1.44 |
| Calcium stearate + Aluminum stearate | −20.0 | −22.1 | −19.7 | −16.0 | 1.01 | 1.38 |

The distribution index as shown in Table 3 is a measurement of the charge distribution of the toner particles. Ideally, the distribution is narrow. Preferably, the distribution index is less than 2.0, and more preferably less than 1.5, and even more preferably less than 1.0.

TABLE 3

Distribution Index Prior to Admix

| Distribution Index | 15 min. C-zone | 45 min. C-zone | 15 min. B-zone | 45 min. B-zone |
|---|---|---|---|---|
| Aluminum stearate | 0.77 | 0.57 | 1.11 | 0.97 |
| Calcium stearate | 0.83 | 0.59 | 1.09 | 1.07 |
| Calcium stearate + Aluminum stearate | 0.92 | 0.66 | 1.25 | 1.11 |

Flow cohesion as demonstrated in Table 4 is a measurement of the extent to which the toner particles stick to each other. Preferably the flow cohesion is less than 10 percent.

TABLE 4

Flow Cohesion of Toner Prior to Admix

| Flow Cohesion | % |
|---|---|
| Aluminum stearate | 5.5 |
| Calcium stearate | 5.7 |
| Calcium stearate + Aluminum stearate | 5.6 |

Table 5, Table 6 and Table 7 show the performance of the developers with calcium stearate alone, aluminum stearate alone, and with the mixture of calcium and aluminum stearate, in a Xerox iGen3 developer housing running at 100 ppm. Table 5 confirms that all toners have similar and acceptable charge in the developer housing. Table 6 shows that all toners have similar and acceptable charge distribution index in the developer housing. Table 7 shows that all toners have similar and acceptable developer conductivity. Thus, the toner with the mixture of calcium and aluminum stearates has equal charging and conductivity performance compared to the developers with a single stearate on the toner.

TABLE 5

Toner charge with run time.

| Time (minutes) | Toner q/m (μC/g) CaSt | AlSt | 1:1 CaSt:AlSt |
|---|---|---|---|
| 0 | 21.3 | 20.0 | 23.6 |
| 10 | 19.6 | 22.0 | 23.8 |
| 20 | 20.0 | 22.2 | 24.2 |
| 30 | 18.5 | 23.7 | 25.1 |
| 45 | 19.7 | 25.7 | 25.4 |
| 60 | 20.9 | 26.3 | 27.8 |
| 90 | 24.2 | 29.8 | 31.9 |
| 120 | 25.8 | 31.7 | 35.6 |

TABLE 6

Toner distribution index with run time.

| Time | Distribution Index | | |
|---|---|---|---|
| (minutes) | CaSt | AlSt | 1:1 CaSt:AlSt |
| 0 | 1.18 | 1.21 | 0.97 |
| 10 | 1.23 | 1.18 | 1.12 |
| 20 | 1.18 | 1.16 | 1.11 |
| 30 | 1.13 | 1.16 | 1.01 |
| 45 | 0.99 | 0.89 | 0.87 |
| 60 | 0.91 | 0.87 | 0.63 |
| 90 | 0.77 | 0.76 | 0.58 |
| 120 | 0.73 | 0.65 | 0.58 |

TABLE 7

Toner distribution index with run time.

| Time | Conductivity ($ohm^{-1}$ $cm^{-1}$) | | |
|---|---|---|---|
| (minutes) | CaSt | AlSt | 1:1 CaSt:AlSt |
| 0 | 4.3E−11 | 7.8E−11 | 1.8E−11 |
| 10 | 4.0E−10 | 4.8E−10 | 2.9E−10 |
| 20 | 4.1E−10 | 3.6E−10 | 2.8E−10 |
| 30 | 2.8E−10 | 2.6E−10 | 1.8E−10 |
| 45 | 2.4E−10 | 1.7E−10 | 1.2E−10 |
| 60 | 1.7E−10 | 1.6E−10 | 7.5E−11 |
| 90 | 4.7E−11 | 4.6E−11 | 1.9E−11 |
| 120 | 1.6E−11 | 1.6E−11 | 4.7E−12 |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A toner comprising toner particles of at least one binder, at least one colorant, and external additives, wherein the external additives include at least two metal stearate additives selected from zinc stearate/calcium stearate, zinc stearate/magnesium stearate, aluminum stearate/calcium stearate, calcium stearate/magnesium stearate or aluminum stearate/magnesium stearate.

2. The toner according to claim 1, wherein the external additives include silica and/or titania.

3. The toner according to claim 1, wherein the at least two metal stearates include aluminum stearate/calcium stearate.

4. The toner according to claim 1, wherein the toner is an emulsion aggregation styrene/acrylate toner.

5. The toner according to claim 1, wherein the toner is an emulsion aggregation polyester toner.

6. The toner according to claim 1, wherein the toner is a conventional jetted toner.

7. The toner according to claim 1, wherein the at least two metal stearates are about 0.025% to about 5.0% by weight of the toner particles.

8. The toner according to claim 1, wherein the at least two metal stearates comprise a first metal stearate and a second metal stearate, wherein the ratio of the first metal stearate to the second metal stearate ranges from about 4:1 to about 1:1.

9. An electrophotographic image forming apparatus comprising a photoreceptor, a conductive magnetic brush development system, and a housing in association with the conductive magnetic brush development system for a developer comprising a toner comprising toner particles of at least one binder, at least one colorant, and external additives, wherein the external additives include silica and/or titania, and at least two metal stearates selected from zinc stearate/calcium stearate, zinc stearate/magnesium stearate, aluminum stearate/calcium stearate, calcium stearate/magnesium stearate or aluminum stearate/magnesium stearate.

10. The electrophotographic image forming apparatus according to claim 9, wherein the conductive magnetic brush development system is a hybrid jumping development system.

11. The electrophotographic image forming apparatus according to claim 9, wherein the conductive magnetic brush development system is a hybrid scavengeless development system.

12. A developer comprising a carrier and a toner, wherein the toner comprises toner particles of at least one binder, at least one colorant, and external additives, wherein the external additives include at least two metal stearates selected from zinc stearate/calcium stearate, zinc stearate/magnesium stearate, aluminum stearate/calcium stearate, calcium stearate/magnesium stearate or aluminum stearate/magnesium stearate.

13. The developer according to claim 12, wherein the external additives include silica and/or titania.

14. The developer according to claim 12, wherein the at least two metal stearates include aluminum stearate/calcium stearate.

15. The developer according to claim 12, wherein the at least two metal stearates are about 0.025% to about 5.0% by weight of the toner particles.

16. The developer according to claim 12, wherein the at least two metal stearates comprise a first metal stearate and a second metal stearate, wherein the ratio of the first metal stearate to the second metal stearate is ranges from about 4:1 to about 1:1.

* * * * *